US008202046B2

(12) United States Patent
Buell

(10) Patent No.: US 8,202,046 B2
(45) Date of Patent: Jun. 19, 2012

(54) SELF PRIMING CENTRIFUGAL PUMP

(75) Inventor: Steven E. Buell, Sterling Heights, MI (US)

(73) Assignee: MP Pumps, Inc., Fraser, MI (US)

( * ) Notice: Subject to any disclaimer, the term of this patent is extended or adjusted under 35 U.S.C. 154(b) by 881 days.

(21) Appl. No.: 12/194,753

(22) Filed: Aug. 20, 2008

(65) Prior Publication Data

US 2009/0053049 A1 Feb. 26, 2009

Related U.S. Application Data

(60) Provisional application No. 60/957,308, filed on Aug. 22, 2007.

(51) Int. Cl.
*F04D 29/44* (2006.01)
*F04D 29/54* (2006.01)

(52) U.S. Cl. ..... 415/203; 415/173.4; 415/196; 415/214.1; 417/423.1

(58) Field of Classification Search ..... 415/196, 415/203, 173.4, 214.1; 417/423.1
See application file for complete search history.

(56) References Cited

U.S. PATENT DOCUMENTS

| | | | | |
|---|---|---|---|---|
| 2,461,925 A | | 2/1949 | Rupp | |
| 2,580,347 A | | 12/1951 | Eggleston | |
| 2,635,549 A | | 4/1953 | Rupp | |
| 2,792,787 A | | 5/1957 | Gudmundsen | |
| 3,229,641 A | | 1/1966 | Hessler | |
| 3,247,801 A | | 4/1966 | Conery | |
| 3,543,368 A | | 12/1970 | Marlow | |
| 3,778,181 A | * | 12/1973 | McFarlin | 415/201 |
| 5,029,878 A | * | 7/1991 | Ray | 277/643 |
| 5,618,168 A | | 4/1997 | Moon | |
| 2006/0269404 A1 | | 11/2006 | Volk | |

FOREIGN PATENT DOCUMENTS

WO 98/48173 A 10/1998

* cited by examiner

*Primary Examiner* — Stephen W Smoot
*Assistant Examiner* — Vicki B Booker
(74) *Attorney, Agent, or Firm* — Katherine H. McGuire, Esq.; Woods Oviatt Gilman LLP

(57) ABSTRACT

A centrifugal pump including a motor connected to a volute housing. The volute housing is configured to receive a pumping mechanism that includes an impeller rotatably connected to the motor. The volute housing may also include a removeable cover that provides access to the interior of the volute housing and to components of the pumping mechanism. In one exemplary embodiment, the removeable cover is connected to the volute housing by fasteners, such as bolts. By removing the cover, the impeller, wear plate, and other components of the pumping mechanism may be disassembled and, if necessary, serviced, without the need to remove the motor from the volute housing. In another exemplary embodiment, a gasket having an integrated flapper valve is secured between the cover and the volute housing. The flapper valve is positioned to align with a fluid inlet formed in the cover and acts as a check valve, substantially preventing fluid within the volute housing from exiting through the inlet.

5 Claims, 5 Drawing Sheets

SELF PRIMING CENTRIFUGAL PUMP

CROSS-REFERENCE TO RELATED APPLICATIONS

This application claims priority of U.S. Provisional Application No. 60/957,308 filed on Aug. 22, 2007.

BACKGROUND OF THE INVENTION

1. Technical Field

The present invention relates to impeller-type pumps, such as centrifugal pumps.

2. Background Art

Centrifugal pumps utilize an impeller and a volute to pump fluids. The impeller, along with other components of the pumping mechanism, is contained within an adaptor that is connected to a motor. The adaptor is then positioned within a volute housing and the motor is connected to the volute housing by a series of bolts. The impeller is rotated by the motor to move fluid along the volute and out of the volute housing. Specifically, fluid is received through an inlet in the volute housing and is directed to the center of the impeller through a wear plate. The fluid received at the center of the impeller is, during rotation of the impeller, moved outward from the impeller's center. The fluid then leaves the edges of the impeller and is guided by the volute, which directs the flow of fluid through the volute housing.

In order to perform maintenance on a centrifugal pump, the bolts connecting the motor to the volute housing are removed. The motor may then be slid away from the volute housing and the impeller, wear plate, and other components of the pumping mechanism that are connected to the motor by the adaptor may be disconnected from the adaptor and then from one another. For example, to remove the wear plate from the adaptor, an additional series of bolts must be loosened and removed. Once any necessary maintenance has been performed on the wear plate, the bolts must be reinserted and tightened to secure the wear plate to the adaptor. The entire motor and adaptor must then be realigned with the volute housing. Once properly aligned and positioned, the motor is reconnected to the volute housing by reinserting and tightening the series of bolts.

SUMMARY OF THE INVENTION

The present invention has application to impeller-type pumps, such as centrifugal pumps. The centrifugal pump of the present invention includes a motor connected to a volute housing. The volute housing is configured to receive a pumping mechanism that includes an impeller rotatably connected to the motor. The volute housing also includes a removeable cover that provides access to the interior of the volute housing and to components of the pumping mechanism. In one exemplary embodiment, the removeable cover is connected to the volute housing by fasteners, such as bolts. By removing the cover, the impeller, wear plate, and other components of the pumping mechanism may be disassembled and, if necessary, serviced, without the need to remove the motor from the volute housing. In another exemplary embodiment, a gasket having an integrated flapper valve is secured between the cover and the volute housing. The flapper valve is positioned to align with a fluid inlet formed in the cover and acts as a check valve, substantially preventing fluid within the volute housing from exiting through the inlet.

In another exemplary embodiment of the centrifugal pump, the wear plate is retained within the volute housing by a resiliently deformable snap ring. For example, a counter bore may be formed in the volute housing for receipt of the snap ring. In one exemplary embodiment, the counter bore is at least partially defined by a tapered surface. Once positioned in the counter bore, the snap ring applies a radially outward force to the tapered surface, directing the snap ring axially toward the wear plate to impart an additional securement force on the wear plate.

Advantageously, the use of a removable cover to provide access to the pumping mechanism of the centrifugal pump eliminates the need to remove the motor from the volute housing to access the pump mechanism. This substantially lessens the time required to service the centrifugal pump. Additionally, maintenance may be performed on the pump at its service location, further lessening the amount of time that the pump is not in service.

Further, using a snap ring to secure the wear plate within the volute housing eliminates the need for additional fasteners, such as bolts, to secure the wear plate in position, which lessens the time required to remove and replace the wear plate. Also, the use of a snap ring decreases manufacturing cost by increasing the acceptable tolerance of the components. Specifically, the snap ring is received in the counterbore and, as a result of its interaction with the tapered surface, moves toward the wear plate to bias the wear plate in position, irrespective of varying tolerances between the components.

Additionally, by utilizing a gasket having a flapper valve, fluid contained within the volute housing is prevented from exiting the volute housing through the fluid inlet. Moreover, by utilizing a gasket having an integral flapper valve, the manufacturing costs and assembly time for the pump of the present invention is substantially lessened.

In one form thereof, the present invention provides a centrifugal pump, including: an impeller rotatably connected to a motor; a volute housing having a counter bore formed therein, the counter bore at least partially defined by a projection extending radially inwardly into the volute housing and a tapered surface; a wear plate having a lip sized to engage the projection; and a snap ring sized for receipt within the counter bore, wherein the interaction of the snap ring with the tapered surface provides a yieldable axial force to the wear plate to secure the wear plate within the counter bore.

In another form thereof, the present invention provides a centrifugal pump, including: a motor; a volute housing having an opening formed therein; an impeller rotatably connected to the motor and contained within the volute housing; a wear plate secured to and contained within the volute housing; and a removable cover secured to the volute housing, the cover configured to seal the opening in the volute housing, wherein removal of the cover provides access to the wear plate.

In yet another form thereof, the present invention provides a centrifugal pump, including: a motor; a volute housing having an opening formed therein; an impeller rotatably connected to the motor and contained within the volute housing; a removable cover secured to the volute housing, the cover having a fluid inlet formed therein; a gasket having an integral flapper secured between the volute housing and the removable cover, wherein the flapper aligns with the fluid inlet to prevent fluid from exiting through the inlet.

The above-mentioned and other features and advantages of this invention, and the manner of attaining them, will become more apparent and the invention itself will be better understood by reference to the following description of an embodiment of the invention taken in conjunction with the accompanying drawings, wherein:

BRIEF DESCRIPTION OF THE DRAWINGS

Corresponding reference characters indicate corresponding parts throughout the several views. The exemplification set out herein illustrates a preferred embodiment of the invention, in one form, and such exemplification is not to be construed as limiting the scope of the invention in any manner.

DETAILED DESCRIPTION OF THE INVENTION

Figure 1:
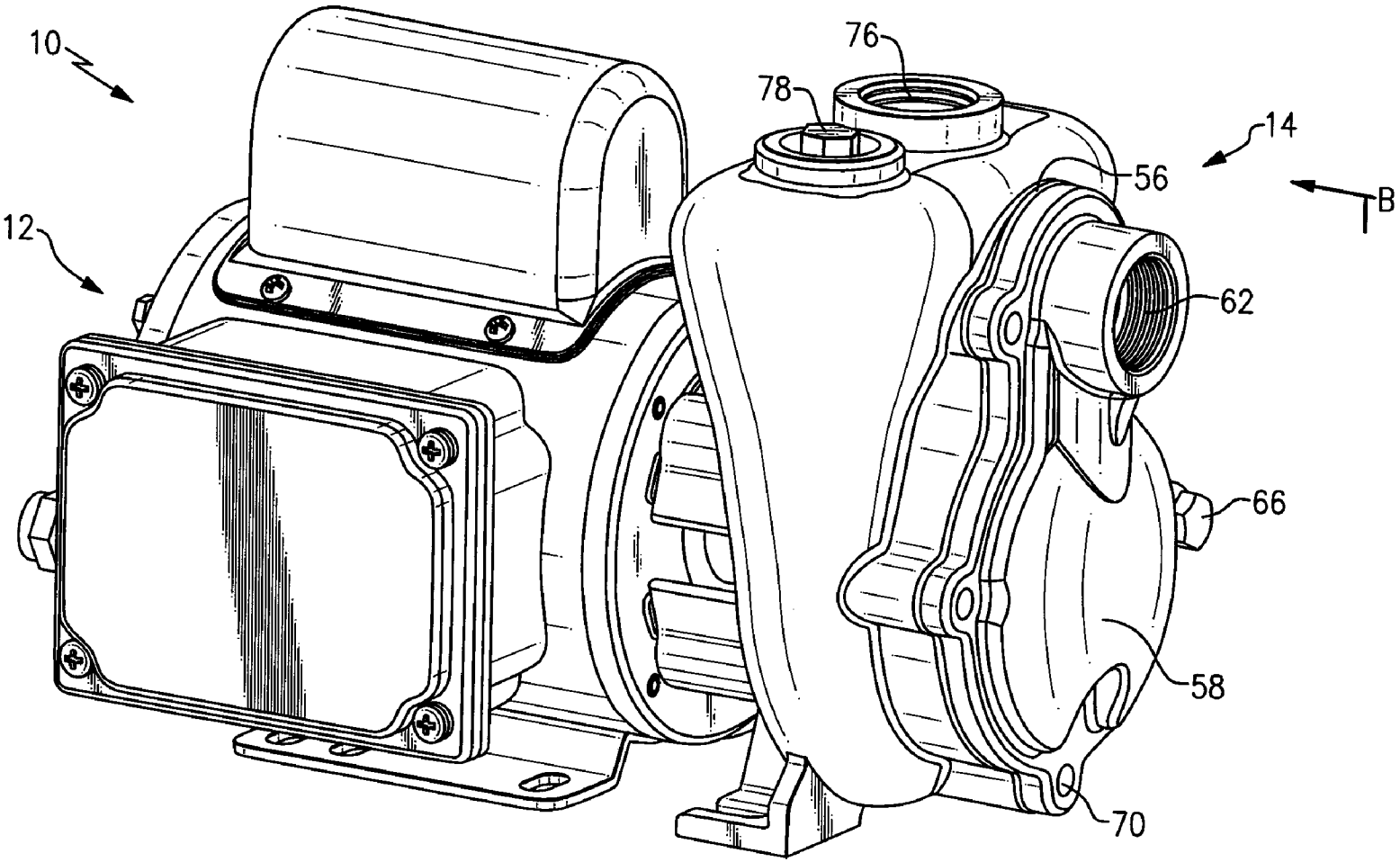
FIG. 1 is a perspective view of a centrifugal pump according to the present invention.
Figure 2:
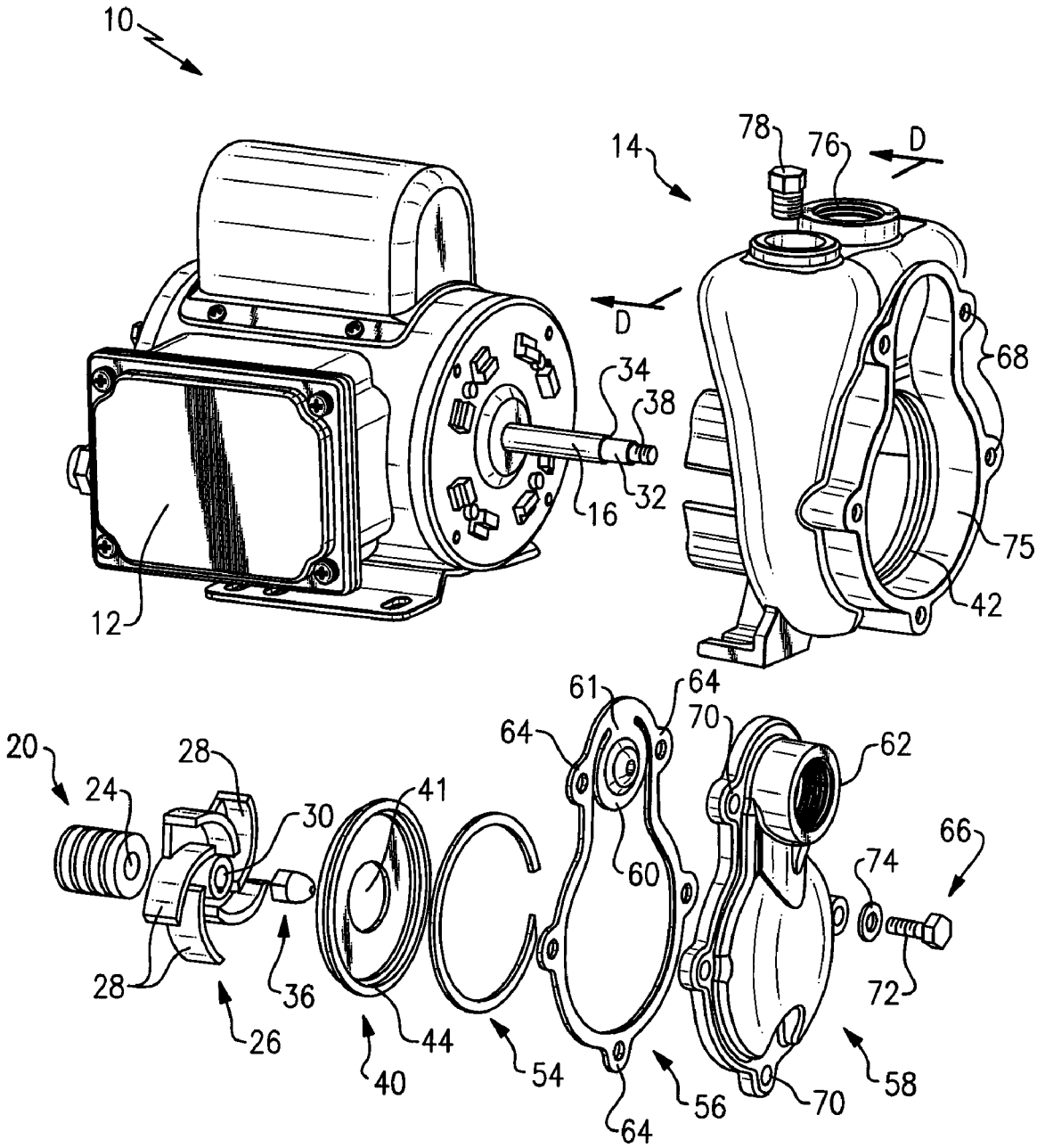
FIG. 2 is an exploded perspective view of the centrifugal pump of FIG. 1.
Figure 3:
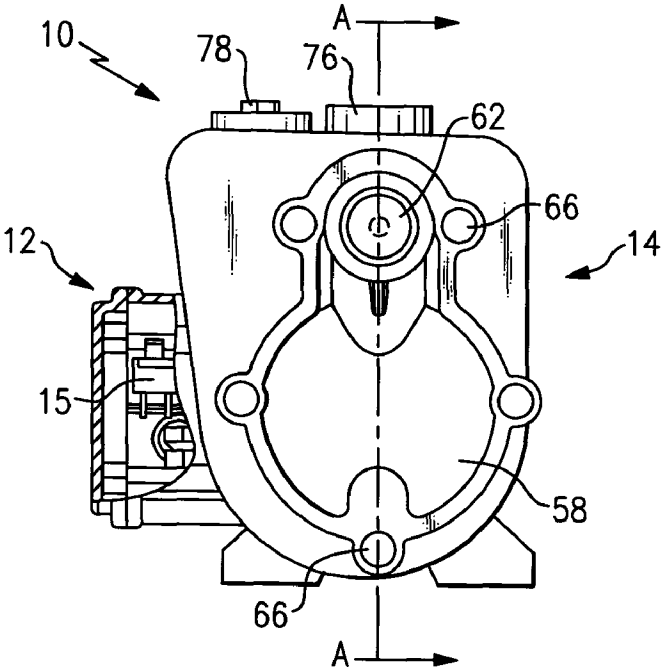
FIG. 3 is partial cross-sectional view of the centrifugal pump of FIG. 1, viewed in the direction of line B-B of FIG. 1.
Figure 4:
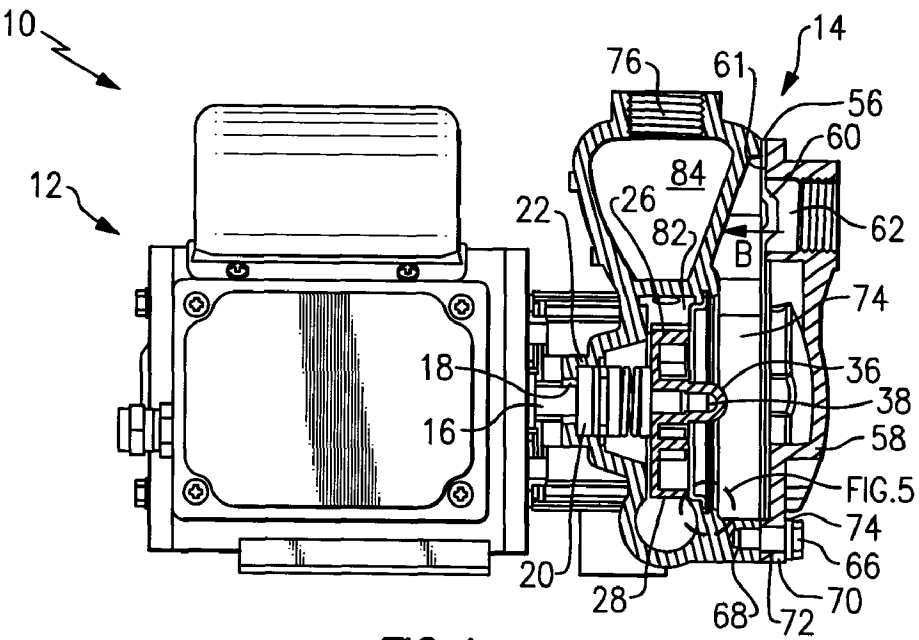
FIG. 4 is a partial cross-sectional view of the centrifugal pump of FIG. 1, taken along line A-A of FIG. 3.

Referring to FIG. 1, centrifugal pump 10 is shown including motor 12 and volute housing 14. In one exemplary embodiment, centrifugal pump 10 is a self-priming pump, the operation of which is described in detail below. Additionally, centrifugal pump 10 may be a marine ignition proof pump capable of operating in regulated marine environments in accordance with the International Organization for Standardization Standard No. 8846, i.e., IS08846. In one exemplary embodiment, motor 12 is configured to operate on both low and high voltage. Referring to FIG. 3, toggle switch 15 is provided to switch between a 115 Volt, 60 Hertz and a 220 Volt, 50-60 Hertz operating mode. Referring to FIG. 2, shaft 16 extends from and is rotatably connected to motor 12. Shaft 16 is configured for receipt within opening 18 (FIGS. 4, 6, and 7) of volute housing 14. Specifically, as shown in FIG. 4, mechanical seal 20 is received within counter bore 22 of opening 18. Mechanical seal 20 is then received on shaft 16 by positioning shaft 16 through aperture 24 (FIG. 2) of mechanical seal 20. By positioning mechanical seal 20 on shaft 16 and within counter bore 22 of opening 18, a fluid tight seal is created between shaft 16 and opening 18 of volute housing 14.

As shown in FIGS. 2 and 4, positioned adjacent mechanical seal 20 on shaft 16 is impeller 26. Impeller 26 includes a plurality of blades 28 that direct the flow of fluid during rotation of impeller 26, as described in detail below. Referring to FIG. 2, aperture 30 extends through impeller 26 and is configured for receipt of shaft 16. In one embodiment, aperture 30 is defined by a pluarlity of splines (not shown) extending from impeller 26. The splines defining aperture 30 are configured to matingly engage corresponding splines (not shown) extending from section 32 of shaft 16. The mating engagement of the splines of impeller 26 with the corresponding splines of shaft 16 rotationally lock impeller 26 and shaft 16 together. To prevent translation of impeller 26 along the longitudinal axis of shaft 16, impeller 26 is secured between shoulder 34 of shaft 16 and cap 36, which is threadingly engaged with threaded end 38 of shaft 16.

Figure 5:
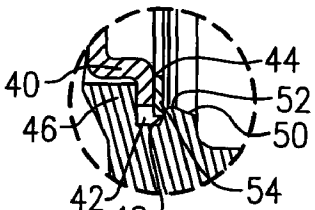
FIG. 5 is an fragmentary cross-sectional view of the centrifugal pump of FIG. 1, depicting the portion of the pump contained within the dashed circle in FIG. 4.

In order to direct the flow of fluid to the center of rotation of impeller 26, wear plate 40 having aperture 41 formed at the center of wear plate 40 is used. Referring to FIGS. 2 and 5, wear plate 40 is received within counter bore 42 machined into volute housing 14. Specifically, wear plate 40 includes annular lip 44 extending radially outwardly from wear plate 40. Lip 44 is oversized with respect to projection 46, which partially defines counter bore 42, allowing lip 44 to engage projection 46, which substantially prevents movement of wear plate 40 in the direction of impeller 26. Counter bore 42 is further defined by tapered surface 48 positioned opposite lead-in surface 50. Defined between tapered surface 48 and lead-in surface 50 is annular projection 52. Annular projection 52 extends radially inwardly and is sized to allow lip 44 of wear plate 40 to pass by projection 52 and seat against projection 46 of counter bore 42.

To secure wear plate 40 to counter bore 42, snap ring 54 is positioned between wear plate 40 and projection 52. Snap ring 54 is sufficiently resiliently deformable to allow a person to manually insert snap ring 54. Specifically, a user inserts snap ring 54 into volute housing 14 in the direction of wear plate 40 until it contacts lead-in surface 50. With snap ring 54 positioned against lead-in surface 50, the user presses snap ring 54 toward wear plate 40, forcing snap ring 54 to deform radially inwardly. As snap ring 54 deforms, it advances along lead-in surface 50 until it passes over projection 52. Once snap ring 54 passes over projection 52, snap ring 54 resiliently expands within counter bore 42 and presses against tapered surface 48. The interaction of snap ring 54 with tapered surface 48 of counter bore 42 causes a camming action that forces snap ring 54 toward wear plate 40. Thus, as a result of snap ring 54 pressing against tapered surface 48, a yieldable axial force is applied to wear plate 40 to press wear plate 40 against projection 46 and further secure wear plate 40 in position. Advantageously, by using snap ring 54 to secure wear plate 40 in position within volute housing 14, the need for additional fasteners, such as bolts and screws, is eliminated, allowing a user to individually and by hand insert, remove, and/or replace wear plate 40. Additionally, the use of snap ring 54 decreases manufacturing cost by increasing the acceptable tolerance range of the components. Specifically, the need to machine the components within small tolerance ranges is eliminated by the biasing action of snap ring 54 that results from interaction with tapered surface 48, which forces snap ring 54 against wear plate 40 irrespective of variations in the tolerance between the components.

Once the pumping mechanism is assembled as described in detail above, gasket 56 is positioned between cover 58 and volute housing 14, as shown in FIGS. 1 and 2, to create a fluid tight seal between cover 58 and volute housing 14. Referring to FIG. 2, gasket 56 includes flapper 60 connected thereto. In one exemplary embodiment, flapper 60 is formed as an integral part of gasket 56. Flapper 60 is connected to gasket 56 by hinge portion 61. Flapper 60 is larger than inlet 62 and by positioning flapper 60 over inlet 62 flapper 60 functions in a manner similar to a check valve. Specifically, flapper 60 allows for fluid to enter volute housing 14 through inlet 62 by flexing inwardly at hinge portion 61 and moving into volute housing 14 in the direction of arrow B of FIG. 4 under pressure from fluid entering inlet 62. Additionally, when fluid within volute housing 14 presses against flapper 60, flapper 60 forms a seal against cover 58 around the periphery of inlet 62 and prevents fluid from exiting volute housing 14 through inlet 62. In order to allow flapper 60 to flex inwardly, flapper 60 and hinge portion 61 are formed from a flexible material, such as a polymer.

Gasket 56 also includes a plurality of eyelets 64 configured to receive bolts 66. Specifically, with gasket 56 placed between cover 58 and volute housing 14, eyelets 64 are aligned with openings 68, 70 (FIG. 2) in volute housing 14 and cover 58, respectively. Bolts 66 are then inserted through openings 70, eyelets 64, and openings 68 to secure cover 58 to housing 14. In one exemplary embodiment, threaded shafts 72 of bolts 66 are threadingly engaged with openings 68 in volute housing 14. Further, in one exemplary embodiment, washers 74 are positioned on threaded shafts 72 of bolts 66 to further facilitate securement of cover 58 to volute housing 14. In order to service pump 10, bolts 66, cover 58, and gasket 56 are removed. Access to snap ring 54, wear plate 40, impeller 26, and mechanical seal 20, for example, is then provided through opening 75 (FIG. 2) in volute housing 14.

Figure 6:
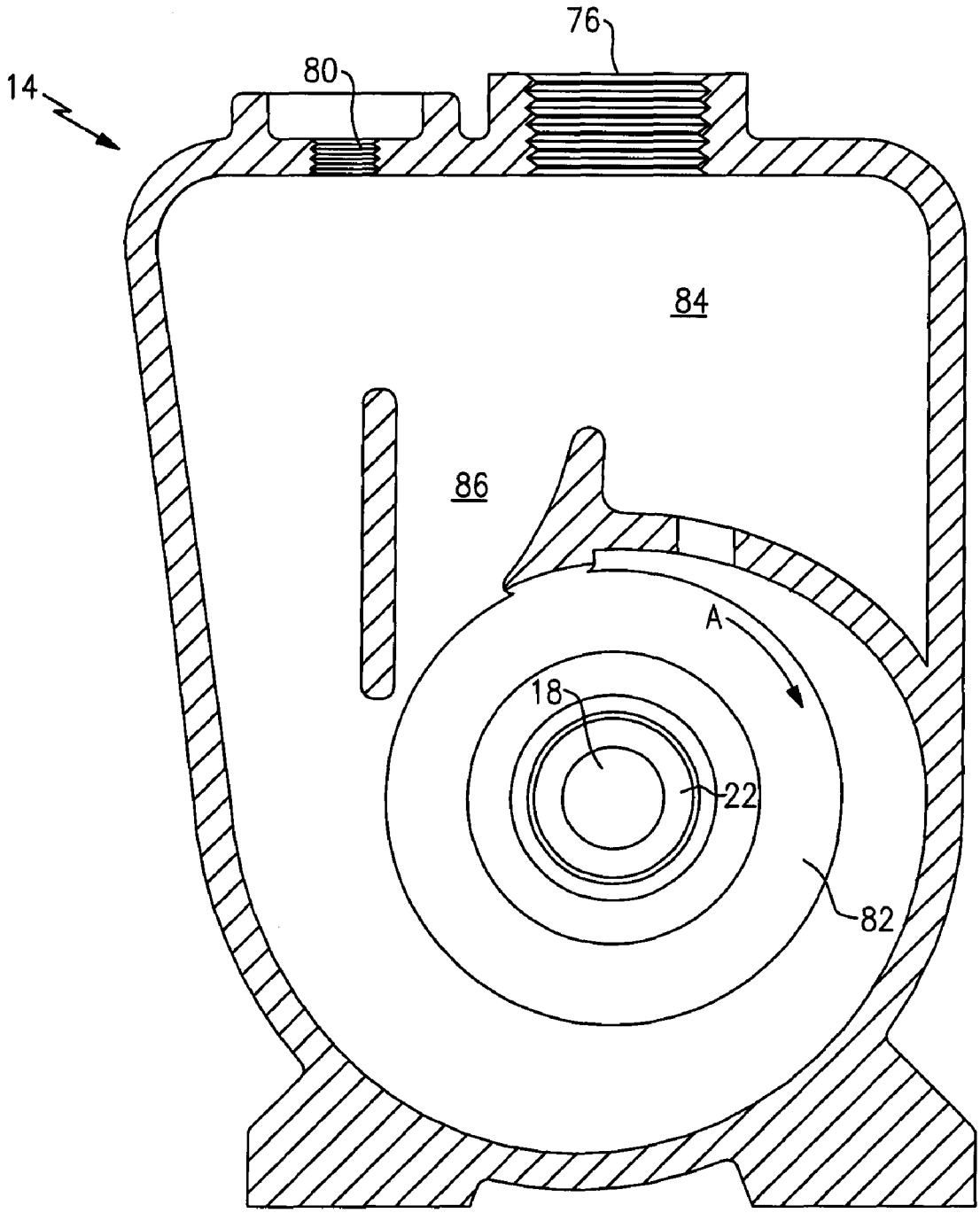
FIG. 6 is a cross-sectional view of the volute housing shown in FIG. 2, taken along line D-D of FIG. 2.
Figure 7:
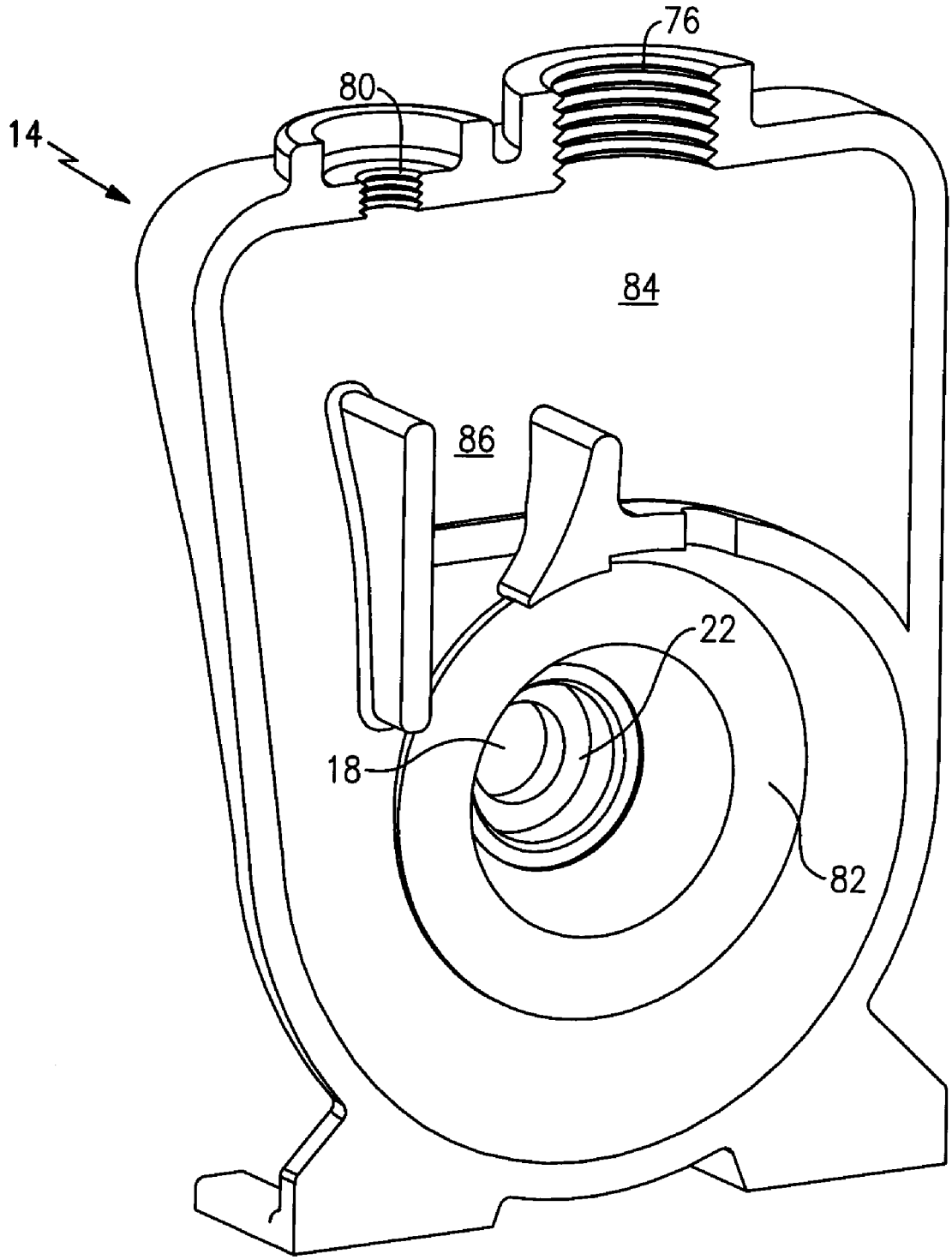
FIG. 7 is another cross-sectional view of the volute housing shown in FIG. 2, taken along line D-D of FIG. 2.

Referring to FIGS. 2, 6, and 7, with pump 10 assembled, pipes (not shown) are connected to fluid inlet 62 and fluid outlet 76 to provide fluid to and receive fluid from pump 10. Once pipes are connected to fluid inlet 62 and fluid outlet 76, pump 10 is ready for initial priming. To prime pump 10, bolt 78 is removed from priming aperture 80 to allow for the receipt of fluid into volute housing 14. Once sufficiently primed, bolt 78 is threadingly engaged with priming aperture 80 to create a fluid tight seal with volute housing 14. In one exemplary embodiment, pump 10 is a self priming pump and, once initially primed, pump 10 does not necessitate re-priming.

During operation of pump 10, motor 12 is activated and shaft 16 of motor 12 is rotated, resulting in corresponding rotation of impeller 26 within pumping chamber 82 (FIG. 4). As a result of the rotation of impeller 26, fluid is drawn through inlet 62, past flapper 60 of gasket 56, and into fluid receiving chamber 74. The fluid within fluid receiving chamber 74 is then drawn through aperture 41 in wear plate 40. When fluid is drawn through aperture 41 of wear plate 40, it enters the center of impeller 26. The fluid is then accelerated away from the center of impeller 26 as it rotates and is forced in the direction of arrow A in FIG. 6. The fluid continues in the direction of arrow A, ultimately reaching head space 84. As fluid accumulates in head space 84 it is forced out of outlet 76.

Once pump 10 is stopped, air may gather in head space 84 and/or pumping chamber 82. In the exemplary embodiment in which pump 10 is a self priming pump, the need to remove bolt 78 from priming aperture 80 and refill pump 10 with fluid is eliminated. Specifically, when pump 10 is restarted, both the fluid and air contained within volute housing 14 are accelerated by impeller 26. As the fluid and air are moved in the direction of arrow A, the air rises into head space 84, as the air is lighter than the fluid. The fluid then falls back toward impeller 26 through channel 86, shown in FIGS. 6 and 7. Additionally, flapper 60 of gasket 56 prevents air and/or fluid from exiting volute housing 14 through inlet 62. Fluid falling back into pumping chamber 82 is then mixed with additional fluid drawn through inlet 62 and into fluid receiving chamber 74. This action continues until a sufficient amount of fluid has built up within head space 84 to force all of the air out of outlet 76. Once fluid receiving chamber 78, pumping chamber 82, and head space 84 are filled with fluid, pump 10 begins to operate at its normal capacity.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A centrifugal pump, comprising:

a) an impeller rotatably connected to a motor;

b) a volute housing having a counter bore formed therein, said counter bore at least partially defined by and between a projection extending radially inwardly into said volute housing and a tapered surface;

c) a wear plate having a lip sized to engage said projection in said counter bore; and d) a snap ring sized for receipt within said counter bore, wherein said snap ring may be compressed radially inwardly during insertion of said snap ring within said counter bore, and upon release of said compression, the interaction of the expansion and associated movement of said snap ring against and along said tapered surface causes said snap ring to become seated against and provide a yieldable axial force to said wear plate to secure said wear plate within said counter bore by and between said snap ring and said projection, said snap ring being removable from said counter bore by compressing said snap ring radially inwardly and withdrawing said snap ring from said housing whereupon said wear plate may then be accessed and removed from said counter bore and said housing.

2. The centrifugal pump of claim 1, wherein said volute housing further comprises a lead-in surface adjacent said tapered surface, wherein said lead-in surface tapers in a direction opposite said tapered surface which thereby facilitates insertion of said snap ring into said counter bore.

3. The centrifugal pump of claim 1, and further comprising:

e) an opening formed in said volute housing on the side of said wear plate opposite said impeller; and f) a removable cover secured to said volute housing, said cover configured to seal said opening in said volute housing, wherein removal of said cover provides access to said snap ring and said wear plate.

4. The centrifugal pump of claim 3, wherein said removable cover further comprises an inlet, said inlet configured to direct fluid into said volute housing.

5. The centrifugal pump of claim 1, and further comprising:

e) an opening formed in said volute housing;

f) a removable cover secured to said volute housing opening, said cover having a fluid inlet formed therein; and g) a gasket having an integral flapper secured between said volute housing and said removable cover, wherein said flapper aligns with said fluid inlet to prevent fluid from exiting through said inlet.

* * * * *